US011879676B2

(12) United States Patent
Larsen et al.

(10) Patent No.: US 11,879,676 B2
(45) Date of Patent: Jan. 23, 2024

(54) THERMAL EXPANSION VALVE FOR A HEAT EXCHANGER AND HEAT EXCHANGER WITH A THERMAL EXPANSION VALVE

(71) Applicant: Danfoss A/S, Nordborg (DK)

(72) Inventors: Sigurd Larsen, Kruså (DK); Ali Foulladpour, Nordborg (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 17/389,975

(22) Filed: Jul. 30, 2021

(65) Prior Publication Data

US 2023/0034047 A1 Feb. 2, 2023

(51) Int. Cl.
*F25B 41/335* (2021.01)

(52) U.S. Cl.
CPC ..... *F25B 41/335* (2021.01); *F25B 2341/064* (2013.01)

(58) Field of Classification Search
CPC ..... F25B 41/335; F25B 2341/0683; F25B 2341/064; F25B 39/028
See application file for complete search history.

(56) References Cited

U.S. PATENT DOCUMENTS 2,594,701 A * 4/1952 Wolf ..... F25B 41/335 137/454.2
3,388,864 A 6/1968 Noakes
3,785,554 A * 1/1974 Proctor ..... F25B 41/335 62/212
3,934,426 A * 1/1976 Jespersen ..... F25B 41/33 62/DIG. 17
4,589,265 A * 5/1986 Nozawa ..... F25B 39/024 62/526
4,712,384 A * 12/1987 Crowe ..... F25B 41/335 165/279
4,809,518 A 3/1989 Murayama
5,257,737 A * 11/1993 Vestergaard ..... F25B 41/335 236/92 B
5,706,853 A 1/1998 Ronnow et al.
(Continued)

FOREIGN PATENT DOCUMENTS

CN 101413743 B 6/2010
CN 101413742 B 10/2010
(Continued)

OTHER PUBLICATIONS

International Search Report for corresponding PCT Application No. PCT/IB2022/057078, dated Oct. 19, 2022.
(Continued)

*Primary Examiner* — Jessica Cahill
(74) *Attorney, Agent, or Firm* — McCormick, Paulding & Huber PLLC

(57) ABSTRACT

The present invention pertains to a thermal expansion valve for a heat exchanger with at least one header. The valve includes a valve block and a superheat defining mechanism. The valve block includes a high pressure inlet, a low pressure outlet, a first suction gas port and a second suction gas port. A contact surface for coupling the valve to the header includes at least one cylindrical portion of the valve block. The invention is also directed at a heat exchanger with a corresponding thermal expansion valve.

13 Claims, 6 Drawing Sheets

(56) References Cited

U.S. PATENT DOCUMENTS

| | | | | |
|---|---|---|---|---|
| 6,189,326 | B1 * | 2/2001 | Tomatsu | F25B 41/335 62/222 |
| 6,206,294 | B1 | 3/2001 | Fujimoto et al. | |
| 6,223,994 | B1 | 5/2001 | Fukuda et al. | |
| 6,427,480 | B1 | 8/2002 | Ito et al. | |
| 6,467,290 | B2 | 10/2002 | Minowa et al. | |
| 6,626,365 | B2 | 9/2003 | Kobayashi et al. | |
| 6,766,993 | B2 | 7/2004 | Rasmussen et al. | |
| 7,513,684 | B2 | 4/2009 | Hart | |
| 7,536,872 | B2 | 5/2009 | Ohta et al. | |
| 8,113,270 | B2 | 2/2012 | Rios et al. | |
| 8,596,081 | B2 * | 12/2013 | Bram | F25B 39/028 62/527 |
| 8,596,552 | B2 | 12/2013 | Nicolaisen et al. | |
| 8,851,394 | B2 | 10/2014 | Ikegami et al. | |
| 8,966,923 | B2 * | 3/2015 | Haussmann | F25B 41/45 62/299 |
| 9,334,967 | B2 | 5/2016 | Larsen et al. | |
| 9,644,905 | B2 | 5/2017 | Rusich | |
| 9,726,407 | B2 | 8/2017 | Oshitani et al. | |
| 10,344,884 | B2 | 7/2019 | Harck et al. | |
| 10,814,426 | B2 | 10/2020 | Harck et al. | |
| 2004/0011078 | A1 | 1/2004 | Kobayashi et al. | |
| 2004/0112073 | A1 * | 6/2004 | Ito | F25B 40/00 62/196.4 |
| 2010/0024453 | A1 | 2/2010 | Matsui et al. | |
| 2010/0163637 | A1 | 7/2010 | Ikegami et al. | |
| 2021/0156599 | A1 | 5/2021 | Heschel et al. | |
| 2021/0239412 | A1 | 8/2021 | Amick et al. | |
| 2023/0034594 | A1 | 2/2023 | Rasmussen et al. | |
| 2023/0132359 | A2 | 4/2023 | Kumakura et al. | |

FOREIGN PATENT DOCUMENTS

| | | | | |
|---|---|---|---|---|
| CN | 103363835 | B | 10/2013 | |
| CN | 103712376 | A | 4/2014 | |
| CN | 103712383 | A | 4/2014 | |
| CN | 203758096 | U | 8/2014 | |
| CN | 104457037 | A | 3/2015 | |
| CN | 208091024 | U | 11/2018 | |
| DE | 19805285 | A1 | 8/1999 | |
| EP | 1 382 921 | B1 | 11/2008 | |
| EP | 3179144 | A1 | 6/2017 | |
| EP | 3 187 758 | A1 | 7/2017 | |
| EP | 2986874 | B1 | 12/2017 | |
| EP | 3 455 565 | A1 | 3/2019 | |
| EP | 3671070 | A1 | 6/2020 | |
| EP | 3671071 | A1 | 6/2020 | |
| EP | 3671072 | A1 | 6/2020 | |
| EP | 3671073 | A1 | 6/2020 | |
| EP | 3672030 | A1 | 6/2020 | |
| GB | 2483688 | A | 3/2012 | |
| JP | 2008-275198 | A | 11/2008 | |
| JP | 2010-91161 | A | 4/2010 | |
| JP | 5250446 | B2 | 7/2013 | |
| JP | 2016-90201 | A | 5/2016 | |
| SE | 531780 | C2 | 8/2009 | |
| WO | 9414021 | A1 | 6/1994 | |
| WO | 2005121685 | A1 | 12/2005 | |
| WO | 200683448 | A1 | 8/2006 | |
| WO | 2006055277 | A1 | 8/2006 | |
| WO | 2006083446 | A3 | 8/2006 | |
| WO | 200800823 | A1 | 1/2008 | |
| WO | 200845111 | A1 | 4/2008 | |
| WO | 200902256 | A1 | 12/2008 | |
| WO | WO-2017194651 | A1 * | 11/2017 | F16K 1/52 |
| WO | 2020020114 | A1 | 1/2020 | |

OTHER PUBLICATIONS

Written Opinion for corresponding PCT Application No. PCT/IB2022/057078, dated Oct. 19, 2022.

International Search Report for corresponding PCT Application No. PCT/IB2022/057079, dated Oct. 20, 2022.

Written Opinion for corresponding PCT Application No. PCT/IB2022/057079, dated Oct. 20, 2022.

Handbook of Air Conditioning and Refrigeration; Shan K. Wang; Second Edition; McGraw-Hill, (2000).

Chapter 17-Heat Exchangers; R.K. Shah* and D.R Sekulib; University of Kentucky; pp. 17.1-17.169.

Article entitled: Refrigerant distribution in the vertical header of the microchannel heat exchanger e Measurement and visualization of R410A flow; Yang Zou et al. International Journal of Refrigeration 36 (2013) pp. 2196-2208.

Article entitled: Shell and Tube Heat Exchangers; Brogan, R.J.; Article dated Feb. 2, 2011; pp. 1/21-10/21.

* cited by examiner

THERMAL EXPANSION VALVE FOR A HEAT EXCHANGER AND HEAT EXCHANGER WITH A THERMAL EXPANSION VALVE

TECHNICAL FIELD

The present invention pertains to a thermal expansion valve for a heat exchanger with at least one header. The valve comprises a valve block and a superheat defining mechanism. The valve block comprises a high pressure inlet, a low pressure outlet, a first suction gas port and a second suction gas port. A contact surface for coupling the valve to the header comprises at least one cylindrical portion of the valve block. The invention is also directed at a heat exchanger with a corresponding thermal expansion valve.

BACKGROUND

Known thermal expansion valves are used for controlling the refrigerant entering an evaporator which is a heat exchanger, such as a micro channel heat exchanger. The valves are usually mounted to the outside of the heat exchanger and fluidly connected to the inside of the heat exchanger by some fluid conduit. Typically, the valves are positioned radially outward of the cylindrical headers. The connection between the valve and the heat exchanger usually increases the complexity as well as the size and therefore the costs of the corresponding system.

SUMMARY

The aim of the present invention is to provide an improved thermal expansion valve and an improved heat exchanger with a corresponding expansion valve, which overcome the above outlined problems.

This aim is achieved by means of a thermal expansion valve according to claim 1 and a heat exchanger according to claim 10. Preferable embodiments are subject to the dependent claims.

According to claim 1, a thermal expansion valve for a heat exchanger with at least one header is provided. The valve comprises a valve block and a superheat defining mechanism. The valve block comprises a high pressure inlet, a low pressure outlet, a first suction gas port and a second suction gas port. A contact surface for coupling the valve to the header comprises at least one cylindrical portion of the valve block. The contact surface extends along the entire circumference or a major portion of the circumference of the valve block. As the header and the valve block comprise matching cylindrical portions, the valve block contacts the header through a cylindrical or near cylindrical contact surface. The contact surface may be a part of the valve block. Therefore, no additional components are required for connecting the valve block to the header. The construction of the valve block and of the complete heat exchanger is therefore simplified and their costs are reduced accordingly.

In a preferred embodiment of the invention, the contact surface comprises an external or internal cylindrical wall of the valve block. Depending on the position of the contact surface, the header may be connected to an external or internal part of the valve block via a matching contact surface of the header.

In another preferred embodiment of the invention, the high pressure inlet is arranged between the first suction gas port and/or second suction gas port on the one side and the low pressure outlet on the other side with respect to an axial direction of the valve block. The axial direction of the valve block may correspond to the connection direction, in which the valve block is connected to the header. In other words, the low pressure outlet may be arranged at and opposite side of the valve block with regard to the position of the gas ports. This makes it easily possible to connect an axial end of the header to the end of the valve block, at which the low pressure outlet is situated. Hence, a direct fluid connection between the low pressure outlet and the inside of the header is easily provided.

In another preferred embodiment of the invention, the superheat defining mechanism and the low pressure outlet are arranged at or close to opposite ends of the valve block and/or the low pressure outlet is oriented in an axial direction of the valve block. The axial direction corresponds to the longitudinal direction of the valve block.

This arrangement further adds to the ease at which the valve block and the header may be combined together. The superheat defining mechanism may comprise any components required for providing a mechanical feedback between the fluid leaving the heat exchanger through the suction gas ports and the opening state of the valve.

In another preferred embodiment of the invention, the valve block is insertable at least partially into an axial end-portion of the header and/or an axial end-portion of the header is at least partially insertable into an axial end-portion of the valve. The invention is not limited to any of the two possibilities. The axial connectability of the two components simplifies the construction and the assembly of the corresponding system, as an existing axial end-opening of the typically cylindrical header and/or of the valve block can be used for establishing a connection between the two components.

In another preferred embodiment of the invention, the valve block is formed integrally and/or the radial outside of the valve block comprises one or more cylindrical portions and/or conical portions. The radial outside of the valve block may be shaped to fit into a corresponding header portion, such that a desired degree of connection between the two components may be established.

In a particularly preferred embodiment of the invention, the cylindrical portions provided radially outside on the valve block are of smallest radius close to the low pressure outlet and/or the high pressure inlet and of greatest radius close to the superheat defining mechanism, in particular the external components of the superheat defining mechanism. The shape of the valve block may be chosen such that it is easily insertable into the header.

In another preferred embodiment of the invention, a circumferential groove is provided in the valve block at the high pressure inlet and/or the high pressure inlet is orthogonal to the axial direction of the valve.

In another preferred embodiment of the invention, the superheat defining mechanism comprises one or more knife edge portions for providing a seal between the valve block and the superheat defining mechanism.

The invention is also directed at a heat exchanger comprising at least one header and at least one thermal expansion valve. In the heat exchanger, an axial end-portion of the header at least partially encloses a radial outside of the valve block. Alternatively, an axial end-portion of the header is at least partially enclosed by an axial end-portion of the valve The geometries of the header and the valve block are designed to match each other, such that they can be connected to each other In a preferred embodiment of the invention, a swirling chamber is provided between the low pressure outlet and a portion of the header. The swirling chamber is designed to mix and slow down a high velocity jet entering the header from the low pressure outlet. This prevents the high velocity jet from streaming to quickly through the header. As the header is therefore flowed through by a slower and more uniform jet, a more uniform and more efficient heat transfer can be provided at the heat exchanger.

In another preferred embodiment of the invention, the axial end-portion of the header comprises three axially spaced portions of decreasing diameters, wherein the end-portion has the smallest diameter near the low pressure outlet of the valve.

BRIEF DESCRIPTION OF THE DRAWINGS

Further details and advantages of the invention are described with reference to the figures, the figures showing.

DETAILED DESCRIPTION

Figure 1:
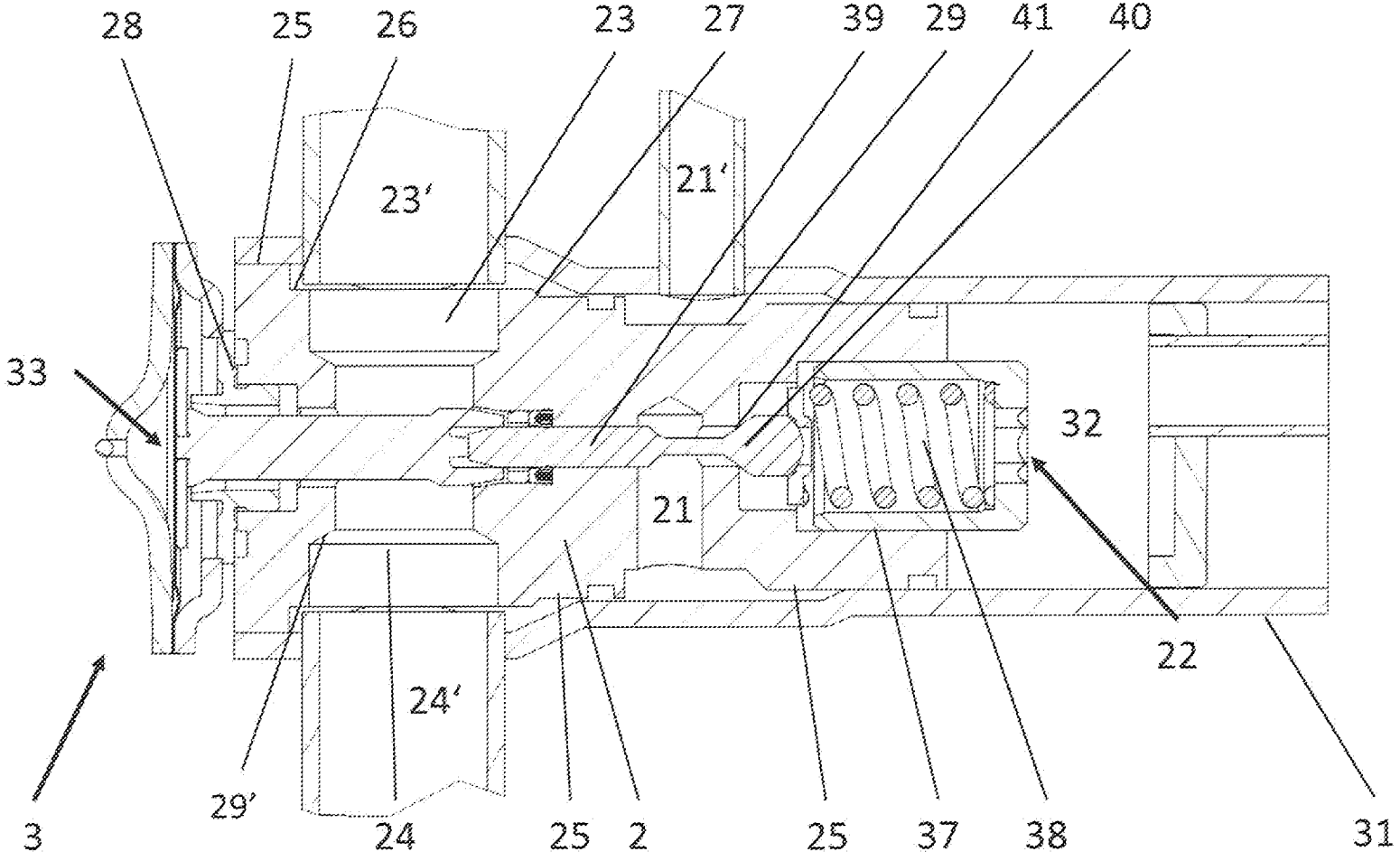
FIG. 1: a sectional view of a first embodiment of the thermal expansion valve.

FIG. 1 is a sectional view of a first embodiment of the thermal expansion valve 1 for a heat exchanger with at least one header 31. The entire heat exchanger is not shown in the figure and only a portion of its header 31 is shown on the right side of the figure. The header 31 may be regarded as a part of the heat exchanger. The valve 1 comprises a valve block 2 that is inserted into the header 31 from left to right in FIG. 1. The valve 1 comprises a superheat defining mechanism 3, which provides mechanical feedback between fluid leaving the heat exchanger and the position of the valve 1.

The valve block 2 comprises a high pressure inlet 21, a low pressure outlet 22, a first suction gas port 23 and a second suction gas port 24. The fluid leaving the heat exchanger flows through the suction gas ports 23, 24 and the fluid entering the heat exchanger flows through the high pressure inlet 21 and the low pressure outlet 22. A conduit to the high pressure inlet 21', to the first suction gas port 23' and to the second suction gas port 24' is provided to connect each of the valve block 2 openings to further components of the entire system.

The superheat defining mechanism 3 comprises a diaphragm portion 33 and a pushpin 39. The pushpin 39 connects the diaphragm portion 33 mechanically to a valve element 40 which can close or open a valve orifice 41 provided on the valve block 2 and then controls the fluid flow between the high pressure inlet 21 and the low pressure outlet 22. The diaphragm portion 33 comprises a diaphragm, which is moved in dependence on the pressure gradient acting on it. This movement of the diaphragm is transmitted to the valve element 40 via the pushpin 39 such that the amount of fluid passing from the high pressure inlet 21 to the low pressure outlet 22 and thus to the heat exchanger is controlled.

A contact surface 25 for coupling the valve 1 to the header 31 comprises at least one cylindrical portion of the valve block 2. The contact surface 25 comprises an external or internal cylindrical wall of the valve block 2. In the case of the embodiment of FIG. 1, the contact surface is an external, i.e. a radially outward facing cylindrical wall of the valve block 2. The embodiment of FIG. 1 comprises three radially outward facing contact surfaces 25 of different diameters, which correspond to and are in contact with three radially inward facing contact surfaces of the header 31.

The high pressure inlet 21 is arranged between the first suction gas port 23 and the second suction gas port 24 on the one side and the low pressure outlet 22 on the other side with respect to an axial direction of the valve block 2. As the valve block 2 may typically be of a cylindrical shape, it can easily be fluidly connected to other matching cylindrical structures.

The superheat defining mechanism 3 and the low pressure outlet 22 are arranged at or close to opposite ends of the valve block 2. It is therefore possible to insert the valve 1 into a structure, such that the low pressure outlet 22 is inside said structure, while the superheat defining mechanism remains partially outside said structure. The low pressure outlet 22 is oriented in a longitudinal direction of the valve block 2. The low pressure outlet 22 may be arranged concentrically with respect to the valve block 2. The low pressure outlet 22 may be defined as a conduit portion, which leads the low pressure fluid out of the valve block 2 and into a volume surrounded at least partially by the header 31.

The low pressure outlet 22 may be provided at a superheat setting screw 37. The superheat setting screw 37 may be turned with respect to the valve block 2 for preloading the diaphragm portion 33. The preloading of the diaphragm portion 33 is a means for adjusting the valve 1 for desired operation conditions. The superheat setting screw 37 and the valve block 2 may be threaded such that the screw 37 can be turned with respect to the valve 1. The superheat setting screw 37 may comprise a hollow portion, which forms a part of the low pressure outlet 22. The superheat setting screw 37 may comprise a hexagon socket, which reaches into the hollow portion of the superheat setting screw 37. Inside the hollow portion of the superheat setting screw 37, a spring 38 may be provided. The spring 38 may be compressed by turning the superheat setting screw 37 into the valve block 2. The spring 38 acts on the pushpin 39 and the diaphragm portion 33 such that the grade of compression of the spring 38 determines the preload exerted on the diaphragm portion 33 of the superheat defining mechanism 3.

Due to its described shape, the valve block 2 is insertable at least partially into an axial end-portion of the header 31. The valve block 2 may in fact be fully insertable into the axial end-portion of the header 31. The valve block 2 may be an integrally formed structure, comprising fluid conduits, contact surfaces and other features required for the operation of the valve 1.

The radial outside of the valve block 2 may comprise one or more cylindrical portions 26 and conical portions 27. Although only one cylindrical portion 26 is indicate in FIG. 1, some or all cylindrical outer portions of the valve block 2 may be regarded as corresponding cylindrical portions 26.

The cylindrical portions 26 may be shaped such that the valve block 2 is adapted to fit into a header 31, which features cylindrical portions of different diameters. The conical portions 27 may connect cylindrical portions 26 of different diameters and/or contact surfaces 25 to each other. The cylindrical portions 26 may also represent some or all of the contact surfaces 25 for providing a contact between the valve block 2 and the header 31.

The valve block 2 may be designed such that the cylindrical portions 26 provided radially outside on the valve block 2 are of smallest radius close to the low pressure outlet 22 and/or the high pressure inlet 21 and of greatest radius close to the external portion of the superheat defining mechanism 3, in particular to its diaphragm portion 33 shown on the left in FIG. 1. The arrangement of the cylindrical portions 26 may be chosen such that the valve block 2 is easily insertable into the header 31 and can be brought in contact with portions of the header 31, which have varying, in particular decreasing, diameters.

A complete heat exchanger with a valve 1 according to the first embodiment comprises an axial end-portion of the header 31 with three axially spaced portions of decreasing diameters, wherein the end-portion of the header 31 has the smallest diameter near the low pressure outlet 22 of the valve 1.

A circumferential groove 29 is provided in the valve block 2 at the high pressure inlet 21. The circumferential groove 29 may facilitate fluid flow from the outside of the valve block 2, into the high pressure inlet 21. In particular, due to the presence of the circumferential groove 29, a fluid conduit connected to the high pressure inlet 21 does not have to align with the high pressure inlet 21. Therefore, it provides larger design freedom and allows for lower tolerances. The circumferential groove 29 may be the portion of the valve block 2 with the smallest external diameter. The high pressure inlet 21 is arranged orthogonal to the axial direction of the valve 21 and to the low pressure outlet 22.

A further groove 29' may be provided at the valve block 2 at the first and second suction gas ports 23, 24. The fluid conduits connected to the first and second suction gas ports 23, 24 do not have to align with the first and second suction gas ports 23, 24. Therefore, larger design freedom and lower tolerances are possible. Although reference is made to circumferential groves, any grove geometry, such as e.g. radial grooves may be employed, so long as it enables the desired fluid flow characteristics.

In order to connect the diaphragm portion 33 to the valve block 2, one or more knife edge portions 28 are provided. The knife edge portions 28 provide a sealed connection between the valve block 2 and the superheat defining mechanism 3.

Opposite the diaphragm portion 33, a swirling chamber 32 is provided. The swirling chamber 32 may be the first portion a fluid flow enters upon leaving the valve block 2 through the low pressure outlet 22. The swirling chamber 32 may be designed such that it prevents a fluid jet from flowing unchanged from the low pressure outlet 22 into the header 31. The fluid flow exiting the low pressure outlet 22 is mixed and diffused in the swirling chamber 32, such that a more homogenous flow is achieved along the length of the header 31.

Figure 2:
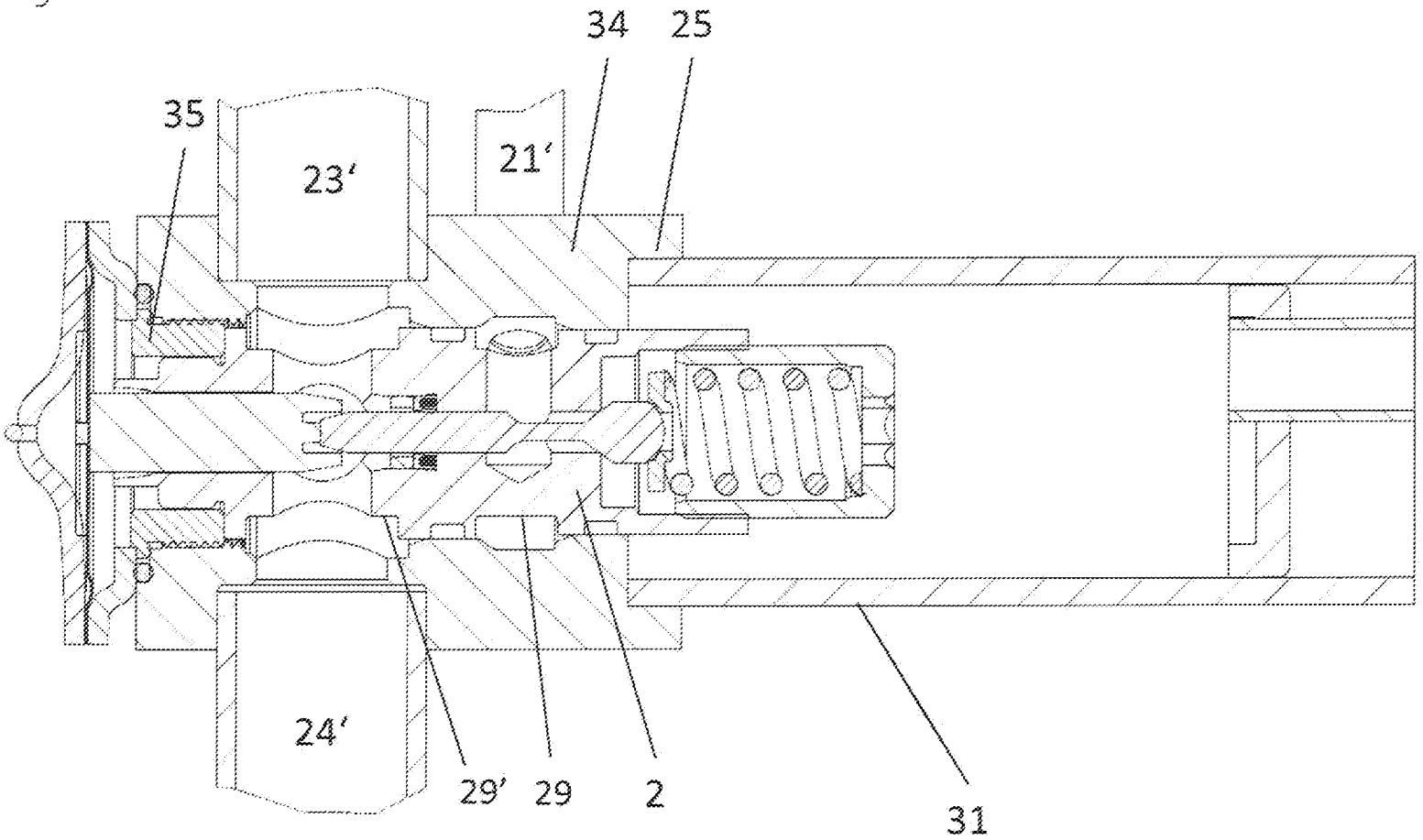
FIG. 2: a sectional view of a second embodiment of the thermal expansion valve.

FIG. 2 is a sectional view of a second embodiment of the thermal expansion valve 1. As most components are similar or identical to the ones shown in FIG. 1, they are not described in detail again. A difference to the first embodiment is that the header 31 is inserted into a part of the valve block 2, rather than the other way round. This means that the contact surface 25 comprises an internal cylindrical wall of the valve block 2. An axial end-portion of the header 31 is partially inserted into an axial end-portion of the valve 1, such that the valve block 2 and the header 31 are in contact with each other via the contact surface 25. The valve block 2 is not inserted into the header 31 and the header 31 may comprise a constant diameter, cylindrical axial end-portion.

The valve block 2 may comprise or be connected to a contact block 34 for connecting the valve block 2 to the header 31. The two blocks 2, 34 may be integrated with each other or they may be formed from two separate components, which are joined together during assembly of the valve 1. The contact block 34 may be screwed to the valve block 2 directly or a separate screw element 35 may be used for screwing the contact block 34 to the valve block 2.

Figure 3:
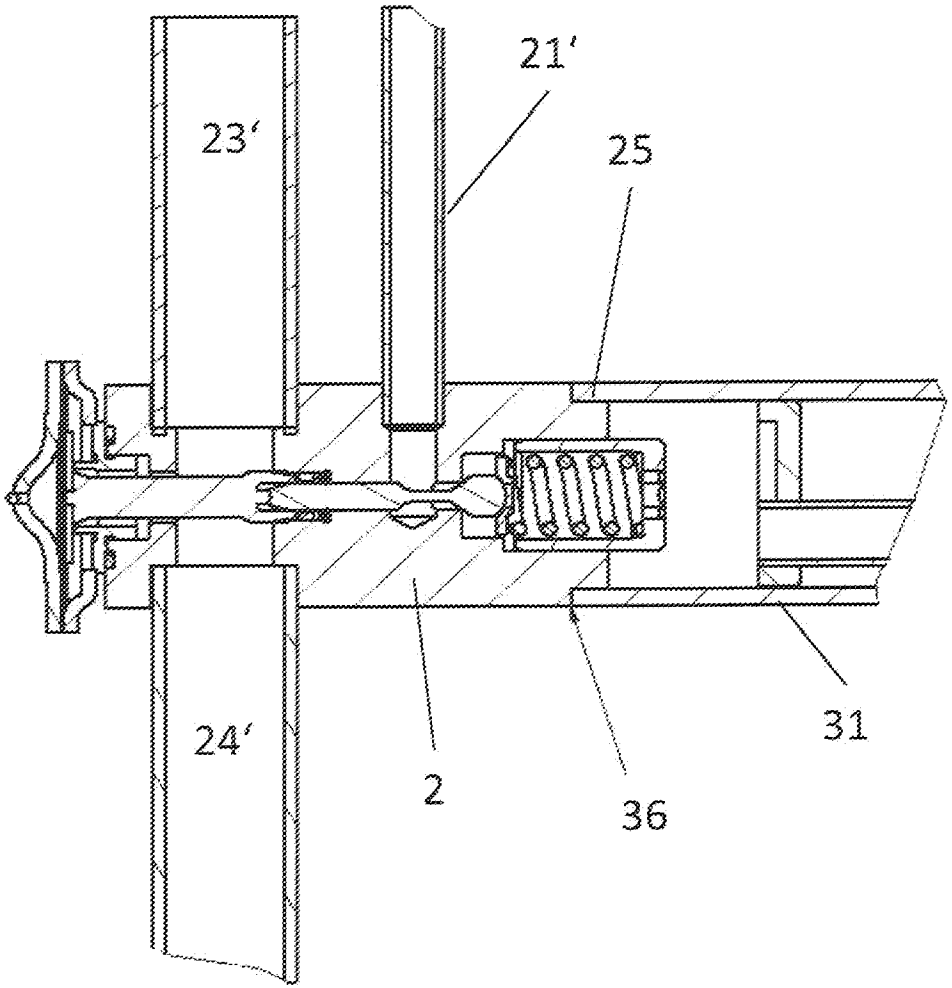
FIG. 3: a sectional view of a third embodiment of the thermal expansion valve.

FIG. 3 is a sectional view of a third embodiment of the thermal expansion valve 1. Again, as most components are similar or identical to the ones shown in FIG. 1, they are not described in detail again. In the third embodiment, the header 31 is connected to the valve block 2 via an external contact surface 25 of the valve block 2. The valve block 2 is only partially inserted into the header 31. The header 31 and the valve block 2 may have the same or nearly the same outer diameter. An external seal 36 may be provided for sealing the header 31 to the valve block 2. The header 31 geometries of the second and third embodiment are less complex than that of the first embodiment. The structure of the valve block 2 of the second and third embodiment of the thermal expansion valve 1 allows for increased brazing areas between the conduits to the high pressure inlet 21, the first suction gas port 23 and the second suction gas port 24 on the one side and the valve block 2 on the other side. The structure of the valve block 2 also allows for lower tolerances, a larger design freedom and better sealing through, amongst others, thread connections. As a downside, the brazing and/or connections to the suction side of the heat exchanger have to be provided only after the heat exchanger brazing, thereby increasing the total cost of the finished system.

Figure 4:
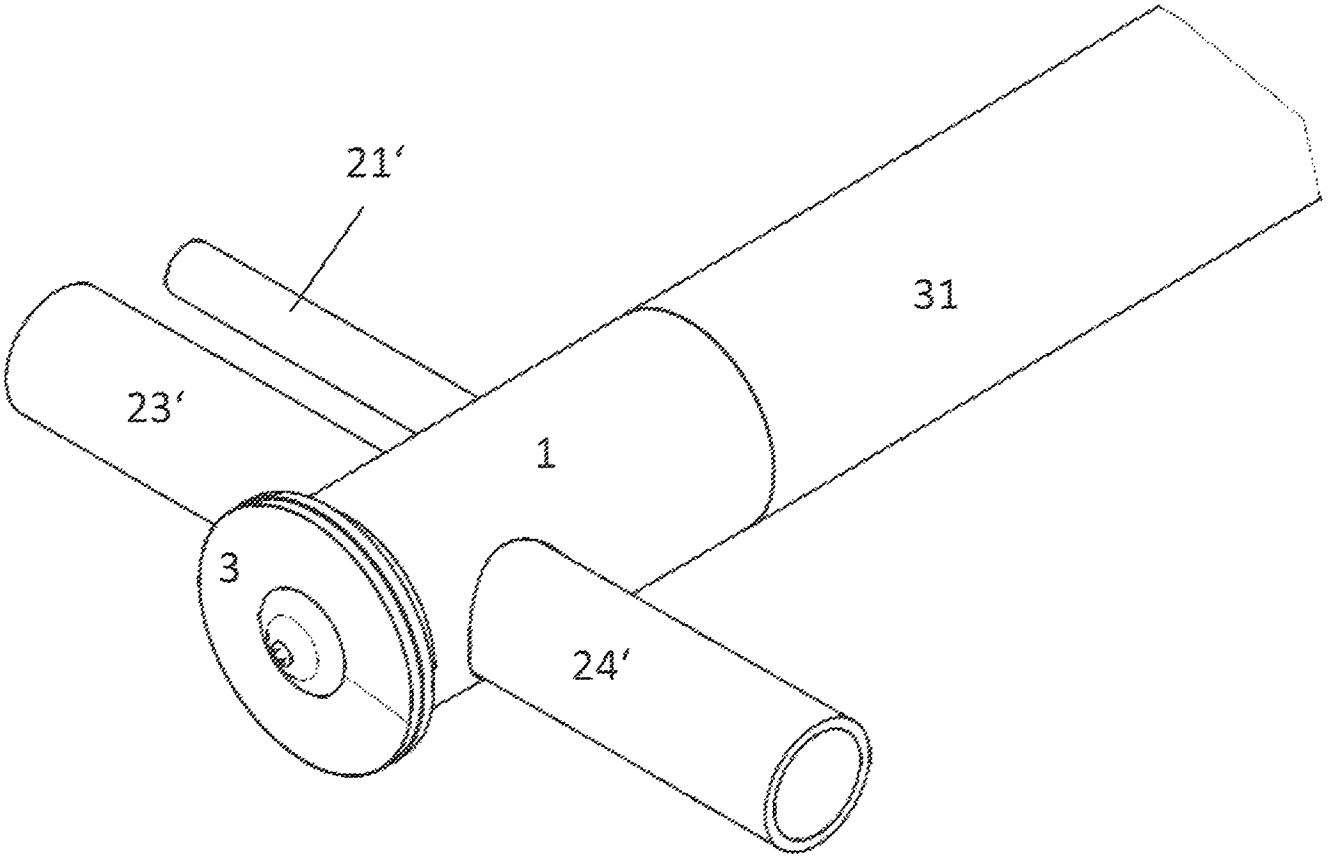
FIG. 4: a view of the third embodiment of the thermal expansion valve inside a part of a header.

FIG. 4 is another view of the third embodiment of the thermal expansion valve 1. The thermal expansion valve 1 is inserted only partially into the header 31. The superheat defining mechanism 3 and the header 31 are positioned at opposite ends of the thermal expansion valve 1. Conduits to the high pressure inlet 21', to the first suction gas port 23' and to the second suction gas port 24' are provided in a planar arrangement.

Figure 5:
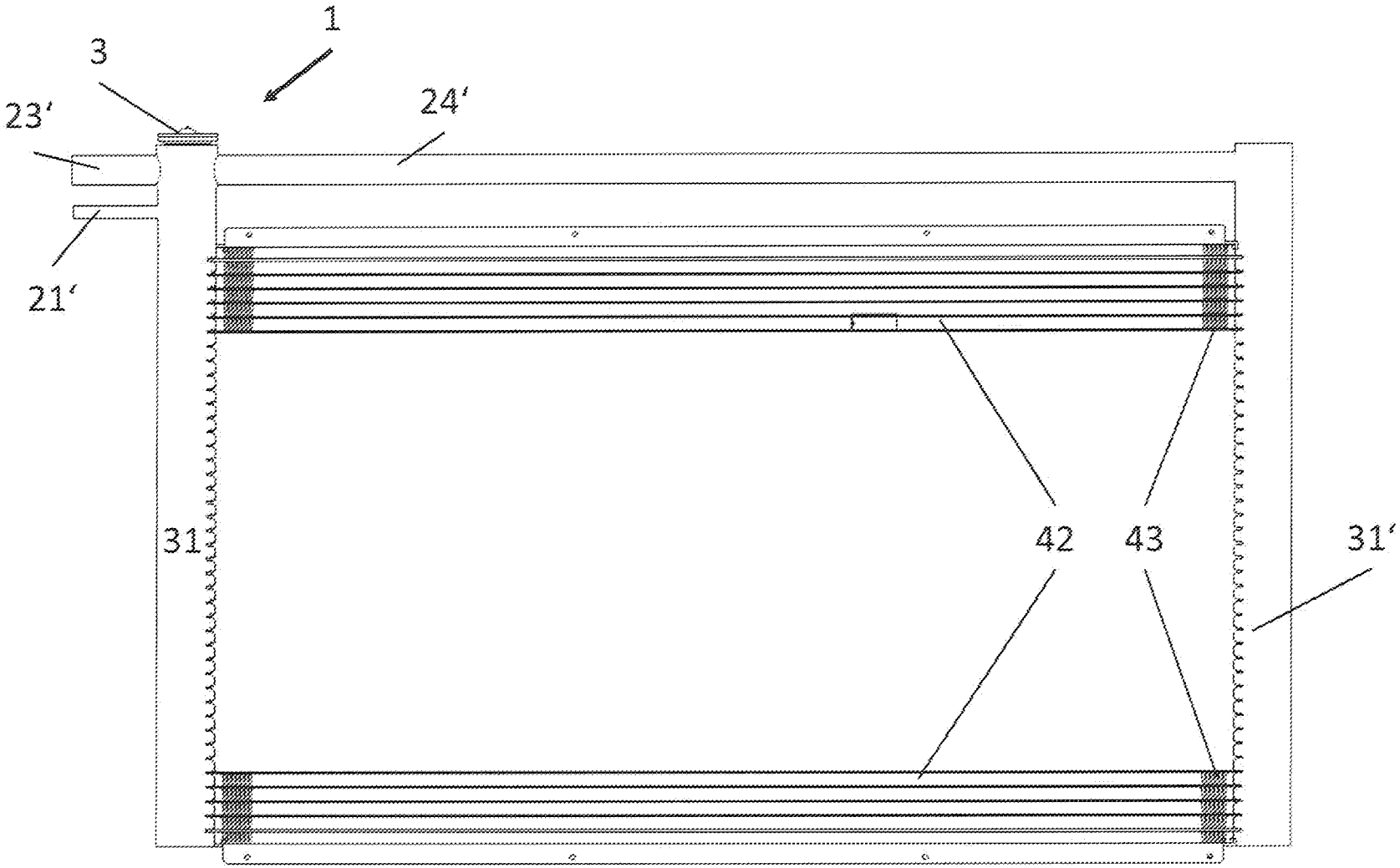
FIG. 5: a view of a heat exchanger with a header and a thermal expansion valve.

FIG. 5 is a view of a heat exchanger with a header 31 and a thermal expansion valve 1. The thermal expansion valve 1 is inserted almost fully into the header 31, such that only a part of its superheat defining mechanism 3 is visible. The header 31 distributes the heat transfer fluid to further heat transfer components, such as heat exchanger tubes 42 and fins 43. The heat exchanger tubes have channels. The channels may be micro channels. The heat transfer components may be arranged between the header 31 and an outlet header 31', such that the heat transfer fluid may flow through the valve 1, into the header 31, through or past the heat transfer components, into the outlet header 31 and back to the valve 1. The heat exchanger tubes 42 and fins 43 are not shown in the entire are between the two headers 31, 31' for clarity's sake. In practice, they may be provided across the entire space between the two headers 31, 31'. The heat exchanger may be a micro channel heat exchanger. The conduits to the high pressure inlet 21', to the first suction gas port 23' and to the second suction gas port 24' are shown as part of the heat exchanger architecture. Depending on the embodiment of the valve 1, the conduits 21'. 23', 24' may be connected indirectly to the valve block 2, i.e. via the header 31, as shown in FIG. 1. Alternatively, the conduits may be connected directly to the valve block 2, as shown in FIGS. 2 and 3.

The conduit to the second suction gas port 24' may be connected to a side wall of the outlet header 31', the side wall being close to one end, in particular an axial end, of outlet header 31'. The conduit to the second suction gas port 24' is approximately parallel to the heat exchange tubes 42. The conduit to the first suction gas port 23' may be connected to a compressor of an air-conditioning system comprising the heat exchanger. The heat exchanger may be an evaporator.

In the embodiment of the heat exchanger shown in FIG. 5, an axial end-portion of the header 31 encloses the radial outside of the valve block 2. The valve block 2 is therefore not visible in FIG. 5. In alternative and inverse embodiments of the heat exchanger, an axial end-portion of the header 31 could at least partially be enclosed by an axial end-portion of the valve 1. These alternative embodiments could comprise valves such as the ones shown in FIGS. 2 and 3. The swirling chamber 32 shown in FIG. 1 is not visible in FIG. 5 as it is situated inside the header 31 and below the valve 1.

Figure 6B:
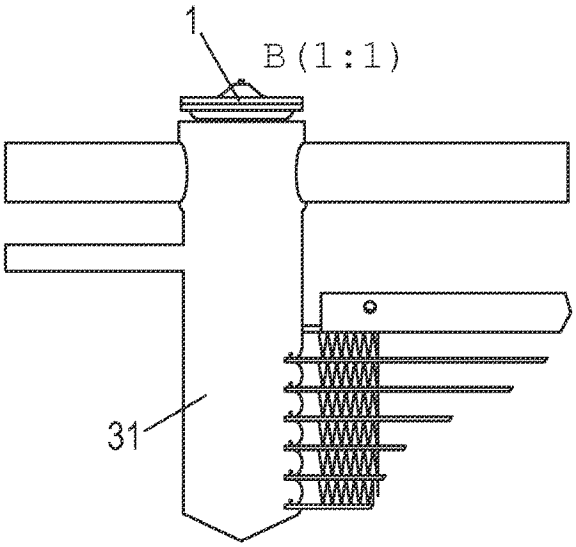
FIGS. 6*a*-6*c*: detailed views of the heat exchanger.
Figure 6C:
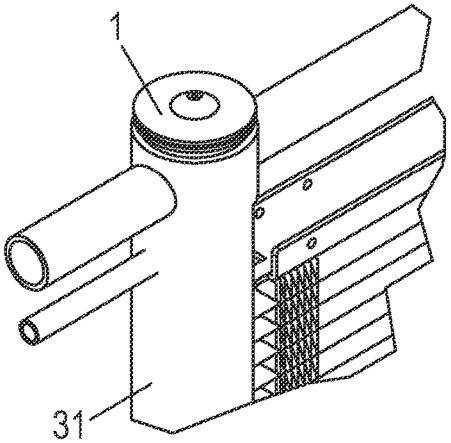
Figure 6A:
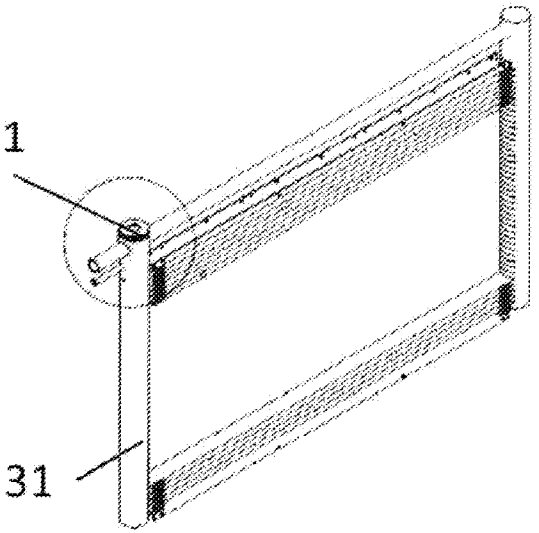

FIGS. 6*a* to 6*c* show detailed views of a heat exchanger with the presently described thermal expansion valve 1. The valve 1 is enclosed by the header 31 of the heat exchanger, such that only its top portion is visible.

The conduits to the high pressure inlet 21', to the first suction gas port 23' and to the second suction gas port 24' visible in FIGS. 6*a* to 6*c* may be brazed to the heat exchanger assembly in the same batch process in which the heat exchanger itself is brazed, thereby saving costly brazing processes later during valve installation. The valve 1 has five interface functions to the heat exchanger that can be achieved in multiple ways.

The valve 1 and in particular the valve block 2 is designed, such that radial alignment with the header 31 can easily be achieved.

The internal seals between the various portions pertaining to high pressure, low pressure, inlet side, outlet side and/or suction side may comprise one or more of each of an O-ring, in particular a rubber O-ring, a seal, in particular a polymer seal, a metal-metal seal and/or some material deformation sealing. An external seal between the low pressure and ambient portions of the valve may comprise one or more of each of an O-ring, in particular a rubber O-ring, a seal, in particular a polymer seal, a metal-metal seal, such as a knife edge seal, brazing and/or welding. The mechanical fixation of the valve 1 may include threaded connections, brazing, welding and/or material deformation, such as swaging.

The interface between the valve 1 and the heat exchanger inlet can be achieved in various structural ways. The valve 1 may be directly and fully or partly inserted into the header 31 or vice versa. Alternatively, an additional interface block or contact block 34 may be provided for connecting the valve 1 to the header 31.

According to the invention, a heat exchanger may be provided, in which manual brazing and the mounting of a SH (superheat) sensor at a customer site are no longer necessary. Instead, only one automated brazing on the heat exchanger manufacturing site is required. Hence, significant saving of manufacturing cost of the valve-heat exchanger module can be realized. At the same time, the physical size and weight of the valve 1 are significantly reduced and the use of expensive copper alloys and tubes is completely eliminated as some or all interface parts are changed to aluminum, thus further reducing the cost and environmental footprint of the valve. Providing the valve 1 as an integral part of the heat exchanger reduces quality related failures and refrigerant leaks as a result of failing capillary tubes of existing solutions.

What is claimed is:

1. A thermal expansion valve for a heat exchanger with at least one header, the valve comprising a valve block and a superheat defining mechanism, wherein the valve block comprises a high pressure inlet, a low pressure outlet, a first suction gas port and a second suction gas port, and wherein a contact surface for coupling the valve to the header comprises at least one cylindrical portion of the valve block.

2. The thermal expansion valve according to claim 1, wherein the contact surface comprises an external or internal cylindrical wall of the valve block.

3. The thermal expansion valve according to claim 1, wherein the high pressure inlet is arranged between the first suction gas port and/or second suction gas port on the one side and the low pressure outlet on the other side with respect to an axial direction of the valve block.

4. The thermal expansion valve according to claim 1, wherein the superheat defining mechanism and the low pressure outlet are arranged at or close to opposite ends of the valve block and/or that the low pressure outlet is oriented in an axial direction of the valve block.

5. The thermal expansion valve according to claim 1, wherein the valve block is insertable at least partially into an axial end-portion of the header and/or that an axial end-portion of the header is at least partially insertable into an axial end-portion of the valve.

6. The thermal expansion valve according to claim 1, wherein the valve block is formed integrally and/or that the radial outside of the valve block comprises one or more cylindrical portions and/or conical portions.

7. The thermal expansion valve according to claim 6, wherein the cylindrical portions provided radially outside on the valve block are of smallest radius close to the low pressure outlet and/or the high pressure inlet and of greatest radius close to the superheat defining mechanism.

8. The thermal expansion valve according to claim 1, wherein a circumferential groove is provided in the valve block at the high pressure inlet and/or that the high pressure inlet is orthogonal to the axial direction of the valve.

9. The thermal expansion valve according to claim 1, wherein the superheat defining mechanism comprises one or more knife edge portions for providing a seal between the valve block and the superheat defining mechanism.

10. A heat exchanger comprising the header and the thermal expansion valve according to claim 1, wherein an axial end-portion of the header at least partially encloses a radial outside of the valve block or that an axial end-portion of the header is at least partially enclosed by an axial end-portion of the valve.

11. The heat exchanger according to claim 10, wherein a swirling chamber is provided between the low pressure outlet and a portion of the header.

12. The heat exchanger according to claim 10, wherein the axial end-portion of the header comprises three axially spaced portions of decreasing diameters, wherein the end-portion has the smallest diameter near the low pressure outlet of the valve.

13. The heat exchanger according to claim 11, wherein the axial end-portion of the header comprises three axially spaced portions of decreasing diameters, wherein the end-portion has the smallest diameter near the low pressure outlet of the valve.

* * * * *